US009368262B2

(12) United States Patent
Golz

(10) Patent No.: US 9,368,262 B2
(45) Date of Patent: Jun. 14, 2016

(54) ACTUATION DEVICE

(75) Inventor: Thomas Golz, Sipplingen (DE)

(73) Assignee: ETO Magnetic GmbH, Stockach (DE)

( * ) Notice: Subject to any disclaimer, the term of this patent is extended or adjusted under 35 U.S.C. 154(b) by 499 days.

(21) Appl. No.: 13/807,332

(22) PCT Filed: Jun. 29, 2011

(86) PCT No.: PCT/EP2011/060902

§ 371 (c)(1),
(2), (4) Date: Feb. 5, 2013

(87) PCT Pub. No.: WO2012/001038

PCT Pub. Date: Jan. 5, 2012

(65) Prior Publication Data

US 2013/0127572 A1 May 23, 2013

(30) Foreign Application Priority Data

Jun. 30, 2010 (DE) ..... 20 2010 009 713 U

(51) Int. Cl.

| | |
|---|---|
| ***H01H 51/34*** | (2006.01) |
| ***H01F 5/00*** | (2006.01) |
| ***H01F 5/04*** | (2006.01) |
| ***H01F 7/06*** | (2006.01) |

(52) U.S. Cl.

CPC .. *H01F 5/00* (2013.01); *H01F 5/04* (2013.01); *H01F 7/06* (2013.01)

(58) Field of Classification Search

CPC ..... H01R 24/64
USPC ..... 336/92
See application file for complete search history.

(56) References Cited

U.S. PATENT DOCUMENTS

| | | | | |
|---|---|---|---|---|
| 2,483,919 | A * | 10/1949 | Mazzola | 336/131 |
| 4,227,238 | A * | 10/1980 | Saito | 361/801 |
| 6,121,865 | A | 9/2000 | Dust et al. | |
| 2009/0189724 | A1 | 7/2009 | Golz et al. | |
| 2012/0038448 | A1 * | 2/2012 | Kim et al. | 336/192 |

FOREIGN PATENT DOCUMENTS

JP 2006019315 1/2006

OTHER PUBLICATIONS

International Search report dated Nov. 29, 2011.

* cited by examiner

*Primary Examiner* — Alexander Talpalatski
(74) *Attorney, Agent, or Firm* — Bachman & LaPointe, PC

(57) ABSTRACT

An electromagnetic actuation device with an actuation element, which can be adjusted relative to a stator on the basis of a magnetic actuation force which can be generated by the stator, wherein the stator has a coil winding, the winding wire of which is guided to a contact element bent at a bending region and is fixedly and electrically conductively connected to the same, wherein the contact element (5) has a depression geometry (9) in a bending region (7), which shortens a bending path of the winding wire (4) and through which the winding wire (4) passes.

15 Claims, 3 Drawing Sheets

ACTUATION DEVICE

BACKGROUND OF THE INVENTION

The invention relates to an electromagnetic actuation device with an in particular elongated actuation element which preferably has a permanent magnet means and can be adjusted relative to a stator on the basis of a magnetic actuation force which can be generated by the stator, wherein the stator has a coil winding, the winding wire of which is guided to a contact element bent at a bending region and is fixedly and electrically conductively connected to the same.

Devices of this type have been known for a long time and are used for manifold purposes. The basic principle consists in a for the most part piston-like actuation element, which has an engagement region for the envisaged actuation task at the end, being guided in a generally magnetically conductive housing as armature between a stationary core region and a bearing element acting as yoke and being actuatable by means of an electromagnet (coil winding) provided in the core region for example.

A generic electromagnetic actuation device with important elements is shown in DE 20 2006 011 904 U1. In the known actuation device, the stator (coil apparatus) comprises a plastic support, onto which a coil winding is wound. The winding wire of the coil winding is overmoulded by the plastic support and guided out of the same. For contacting contact elements to the winding wires, these are initially electrically conductively connected by means of their end regions to the contact elements, whereupon the latter are bent in such a manner that the respective end section thereof extends approximately parallel to the longitudinal axis of the plastic support.

During the bending of the contact elements, a tensile stress acts on the respective winding wire insofar as relief (convexity) cannot be imparted to the same sufficiently for reasons of process technology, which tensile stress the winding wire can transform into length during the bending of the assigned contact element. This can in turn lead to a material weakening and in the extreme case to a tearing out of the winding wire.

SUMMARY OF THE INVENTION

Starting from the previously mentioned prior art, the invention is based on the object of specifying an electromagnetic actuation device with at least one bent contact element, wherein damage of the winding wire fixed on the contact element is reliably avoided during the bending of the same. Preferably, it should not be necessary to relieve the winding wire, which is preferably constructed as varnished copper wire, in terms of process technology as early as in the winding process.

This object is achieved in the case of a generic electromagnetic actuation device in that the contact element has a depression geometry in the bending region, which shortens the bending path of the winding wire (compared to a conventional contact element) and through which the winding wire passes.

Advantageous developments of the invention are also specified herein. All combinations of at least two features disclosed in the description, the claims and/or the figures fall within the context of the invention. To avoid repetitions, features disclosed according to the device should be considered disclosed and can be claimed according to the method. Likewise, features disclosed according to the method should be considered disclosed and can be claimed according to the device.

The invention avoids unacceptable tensile stress on the winding wire, which is in particular constructed as varnished copper wire, by means of the provision of a depression geometry in the contact element, through which the winding wire is passed and thus must only extend over a shorter path than if the winding wire were guided along a non-depressed external surface of the contact element, as in the prior art. Thus, on the basis of the invention, the route to be bridged by the winding wire in a region between the start and the end of the bending region is shortened compared to an embodiment of the contact element without such a depression, that is to say compared to contact elements known from the prior art, in which the winding wire is guided or arranged lying on the contact element at the outer radius of the bending region. Compared to the prior art, the winding wire preferably does not have a continuous arc shape due to the depression geometry in the bending region of the contact element. Preferably, the depression geometry is dimensioned such that the winding wire experiences no or at worst a slight tensile stress during the bending process, in which the contact element is preferably bent by approximately 90°, further preferably in such a manner that the end section thereof runs at least approximately parallel to the adjustment axis. Particularly preferably, a plastic deformation of the winding wire during the bending process of the contact element is completely prevented by means of the provision of a correspondingly configured depression geometry, which in turn leads to the prevention of strength reduction or even a tearing out of the winding wire. A depression geometry is understood to mean a geometry extending in the direction of the thickness extent of the contact element and thus both perpendicularly to the width extent and perpendicularly to the longitudinal extent of the contact element, due to which the winding wire assumes a smaller radius of curvature, i.e. a shorter distance must be bridged than a conceived outer shell contour of the contact element which spans the depression geometry or than the external surface laterally adjacent to the depression geometry.

There are different possibilities with regards to the actual construction of the depression geometry. According to a first alternative, the depression geometry can be constructed as a depression recess, that is to say as a preferably basin-like depression which has a bottom surface and the bottom of which is arranged downwardly offset perpendicularly to the longitudinal extent of the contact element in the direction of the thickness extent of the same, i.e. in the direction of the stator. Alternatively to a depression introduced into the contact element and having a bottom, the depression geometry can be constructed as an opening, that is to say as a bottomless depression geometry. A third possibility consists in the depression geometry being constructed as a recess which is open at the side and extends from a longitudinal side of the contact element at least as far as the middle of the depression geometry, preferably (somewhat) beyond. This depression can be produced with bottom, e.g. by shaping, or without a bottom, preferably by means of stamping out.

Preferably, the axial extent of the depression geometry is chosen from a value range between 1.5 mm and 3.5 mm, preferably between 2.4 mm and 2.8 mm. If the depression geometry is constructed as an opening or depression recess, the width extent thereof is preferably chosen from a value range between 0.5 mm and 2.5 mm, preferably between 1.0 mm and 1.5 mm. If the depression geometry is constructed as an opening, the depth extent thereof is advantageously the thickness extent of the preferably tab-shaped contact element. If the depression geometry is constructed as a depression recess, the depth of the depression geometry is preferably chosen from a value range between 0.1 mm and 1.0 mm, preferably between 0.2 mm and 0.5 mm.

Generally, it is the case that the longitudinal extent, i.e. the axial extent of the contact element is preferably larger than the width extent of the contact element, which is in turn larger than the thickness extent of the contact element.

In a development of the invention, provision is advantageously made for the winding wire, at least in a region (viewed from the exit of the support) laid upstream of the depression and adjoining the depression and also in a region laid downstream of the depression geometry and adjoining the depression geometry, to run on a surface of the contact element directed outwards, i.e. pointing away from the longitudinal axis of the actuation device, in order to obtain a shortening thanks to the depression geometry.

Particularly if the depression geometry is constructed as an opening or the depth of the depression recess is chosen to be correspondingly large, the winding wire runs in a straight line in the bending region, in at least one section, for example between both axial end regions of the depression geometry. In the case of the construction of the depression geometry as depression recess, the winding wire can also run in a straight line in two axial regions, namely in a first region between an axial end of the depression geometry and a bearing region, in which the winding wire reaches the bottom of the depression recess and in a second region between the bottom-side bearing region of the winding wire in the depression recess and the other axial end of the depression recess.

It is particularly expedient if the depression geometry is arranged centrally in relation to the width extent of the contact element or extends at least as far as the middle of the width of the contact element from the horizontal direction, preferably beyond. In this manner, the winding wire can be arranged running at least approximately centrally in relation to the width extent of the contact element.

It is particularly expedient if the depression geometry has a larger longitudinal extent than width extent. Preferably, the depression geometry should be dimensioned in just such a manner that the winding wire does not receive too much relief, in order to prevent damage, particularly cold hardening, due to internal combustion engine vibrations and tearing caused thereby.

It is particularly expedient to design the depression geometry in such a manner that the bending path of the winding wire, that is to say the longitudinal extent of the winding wire is shorter in the bending region than the (actual) course of the winding wire lying on the surface of a contact pin without depression geometry. In other words, the longitudinal extent of the winding wire in the bending region is preferably shorter than the longitudinal extent of an external shell contour (which spans the depression geometry) of the contact element in the bending region. Preferably, the longitudinal extent of the winding wire is shorter in the bending region than a neutral fibre of the contact element in this bending region, in each case measured between the same axial start and end points.

With regards to a possible fixing of the winding wire on the contact element, it is preferred if the winding wire is fixed exclusively in an end section of the contact element arranged downstream of the bending region, that is to say not in a region upstream of the bending region. Particularly preferably, the winding wire is fixed on the contact element by means of welding, particularly expediently by means of inductive welding or soldering, particularly induction soldering or plate soldering. In this case it is yet further preferred if the winding wire is accommodated between a metal plate to be connected to the contact element, particularly by means of welding or soldering, particularly induction welding or soldering, preferably induction welding or soldering, and the contact element.

The depression geometry can be constructed in a particularly cost effective manner by means of stamping, wherein in the case of the construction of a depression recess preferably only one shaping of the contact element is achieved, whereas in the case of the construction of the depression geometry as an in particular central opening, material is stamped out of the contact element.

For further improving the longevity of the actuation device, it is preferred if the depression geometry is provided with a radius in at least one transition region, preferably in both transition regions to the contact element surface which is not depressed in relation to the depression geometry, in order to reliably prevent damage of the winding wire.

Particularly preferably, the contact element is constructed as a type of tab which is held in a support body, preferably by overmoulding. The tab leaves the support body preferably in the radial direction and is bent by 90° outside of the support and then thus extends in the axial direction at the end.

It is particularly preferable if at least two winding wire ends are electrically conductively fixed, particularly by resistance welding or soldering, in each case to a contact element having a depression geometry constructed as previously described.

In order to achieve a certain arrangement, particularly central with respect to the width extent of the contact element, of the winding wire, a winding wire guide geometry is provided on the contact element as a development of the invention, preferably by shaping the same, which winding wire guide geometry defines or fixes a certain position or a situation region of the winding wire, preferably in order to ensure a positioning in the adjacent fixing region which is as exact as possible.

It is particularly expedient in this case if this wire guide geometry is at the same time constructed as fixing geometry which non-positively, preferably positively, fixes the winding wire, particularly by means of clamping, in a certain position on the contact element. In addition to this fixing geometry, at least one further fixing means is preferably also provided, particularly a welding region in which the winding wire is in particular inductively welded or soldered to the contact element, for example by means of so-called plate welding or plate soldering, in which a metal plate is placed onto the winding wire and the contact element, preferably adjacently and/or at a distance from the fixing geometry, and in particular inductively welded or soldered to the same.

It is particularly expedient if the winding wire guide geometry, which is preferably constructed as fixing geometry, is arranged upstream or downstream of a previously mentioned welding region, wherein no winding wire guide geometry is preferably, but not necessarily provided in the actual welding region, rather the winding wire there preferably lies on a planar external surface of the contact element.

BRIEF DESCRIPTION OF THE DRAWINGS

Further advantages, features and details of the invention result from the following description of preferred exemplary embodiments, as well as on the basis of the drawings.

In the figures.

DETAILED DESCRIPTION

In the figures, the same elements and elements with the same function are characterised with the same reference numbers.

Figure 1:
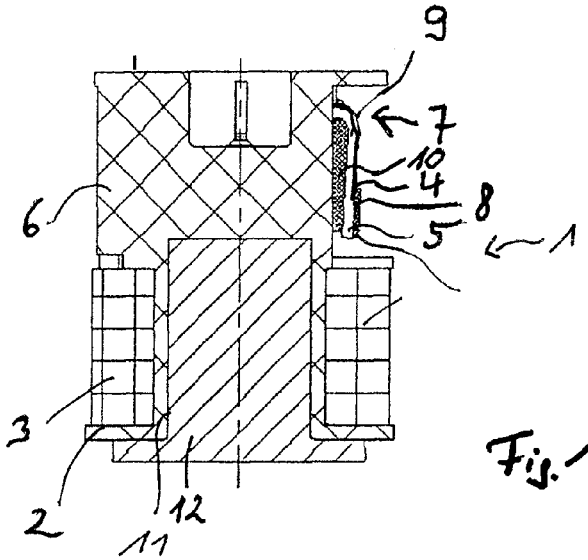
FIG. 1 shows a schematic view of an electromagnetic actuation device.
Figure 2A:
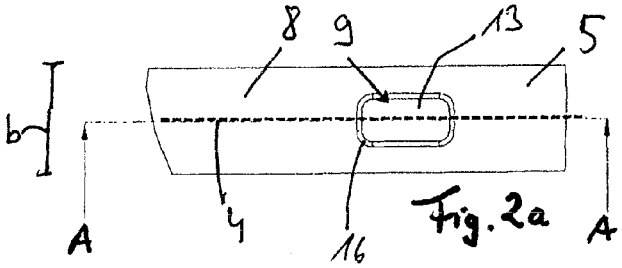
FIG. 2*a* shows a contact element with a depression geometry constructed as a central opening in a partial illustration.

An electromagnetic actuation device 1 is shown in FIG. 1, which interacts in an actuating manner with an actuation partner, for example a camshaft hub shifting, which is not shown. The electromagnetic actuation device comprises a stator 2 with a coil winding 3, wherein an actuation element (armature) which is not illustrated is guided in an axially adjustable manner centrally in the interior of the actuator. To adjust the actuation element, current flows in the coil winding 3, more precisely the winding wire 4 thereof. To contact the winding wire 4, the same is electrically conductively connected at both ends to one tab-shaped contact element 5 in each case, which contact element is guided radially out of a support 6 constructed from plastic and bent by approximately 90° outside of the support 6 in a bending region 7. The winding wire runs on the contact elements 5 on an outwardly directed surface 8 of the respective contact element 5 and is in this case guided in the direction of the longitudinal extent thereof through a depression geometry 9 arranged in the bending region, which is to be mentioned later and shortens the bending path of the winding wire compared to a bending path without a depression geometry thereof.

The contact elements 5 lie on an elastomer cushion 10, preferably a silicone cushion, for reasons of vibration damping, wherein the elastomer cushion 10 connects an inner side or an inner surface of the respective contact element to the support 6. As emerges from FIG. 1, the winding wire 4 is securely connected to the same in an approximately axially parallel end region of the contact element, for example by means of preferably inductive welding or soldering.

As further emerges from FIG. 1, a metallic core region is accommodated in a central blind hole 11 within the support. In a guide tube which is not illustrated, the actuation element, which is likewise not shown, is accommodated.

In the following, different embodiments of possible depression geometries on contact elements are shown on the basis of FIGS. 2*a* to 7*b*, wherein the contact elements 5 are contact elements 5 preferably arranged as in FIG. 1, wherein the contact element 5 is illustrated before the bending in the figures illustrated on the left in each case, that is to say as a contact element extending exclusively in the radial direction, whilst the figures on the right in each case illustrate the bent end position or the mounting end state.

In FIGS. 2*a* to 3*b*, a first exemplary embodiment of a contact element 5 is shown for an electromagnetic actuation device 1 illustrated by way of example in FIG. 1. The metallic tab- or plate-shaped contact element with a thickness extent d, preferably from a range between 0.15 mm and 0.4 mm is to be seen. The width b is preferably between 2.0 mm and 4.0 mm. It is to be seen that a winding wire 4 runs centrally with respect to the width extent on the outwardly directed surface 8, i.e. surface outwardly pointing in the radial direction over a large part of the surface extent thereof in the mounting end state, which winding wire is arranged at a distance from the surface 8 in FIGS. 2*b* and 3*b* for reasons of clarity, but in reality of course lies on the same or runs directly on the same. It is further to be seen that the winding wire 4 is guided axially through a depression geometry 9 which is constructed in the exemplary embodiment according to FIGS. 2*a* to 3*b* as an opening 13 arranged with edge spacing, which is preferably produced by stamping out. The depression geometry 9 has a longer longitudinal than width extent. The depth of the depression geometry corresponds to the thickness extent d of the contact element 5, as the same is constructed as an opening 13 in the exemplary embodiment shown. If the depression geometry is constructed as a depression recess, which is to be explained later, preferably produced by shaping, the depth extent of the depression geometry can also be smaller or larger than the thickness extent d of the metallic contact element 5.

Figure 3A:
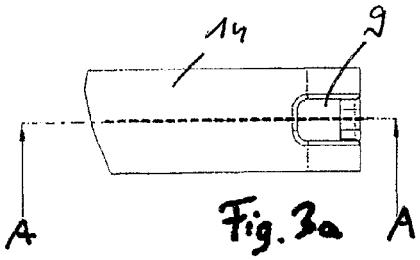
FIG. 3*a* shows the depression geometry according to FIGS. 2*a* and 2*b* in the bent state of the contact element.
Figure 2B:
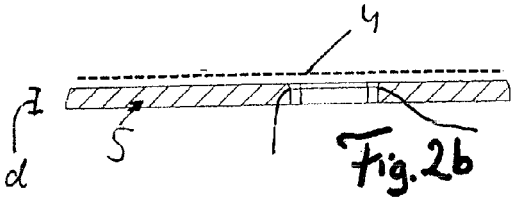
FIG. 2*b* shows a longitudinal sectional view of the illustration according to FIG. 2*a*.
Figure 3B:
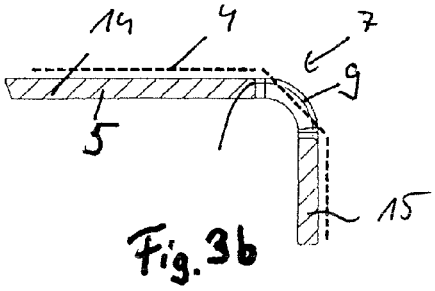
FIG. 3*b* shows a longitudinal sectional view of the illustration according to FIG. 3*a*.
Figure 4A:
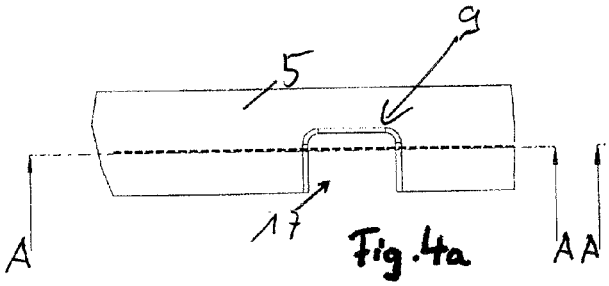
FIG. 4*a* shows an alternative exemplary embodiment of a depression geometry in which the same is constructed as a lateral recess.

It can be seen from the illustrations according to FIGS. 3*a* to 3*b* that the depression geometry 9 is arranged in the bending region 7 in which the contact element 5 is bent. The bending region is understood to mean the region between the start and end of the curvature, that is to say the bent region which connects the two sections 14, 15, here arranged at right angles to one another, of the contact element 5 (with a radius) to one another.

In FIG. 3*b*, the course of the winding wire 4 in the bending region 7 is shown in a schematic manner. Due to the depression geometry 9, the bending path of the winding wire 4 is shortened compared to an embodiment without depression geometry 9. In the exemplary embodiment shown, the winding wire 4 runs between the axial start and the axial end of the depression geometry 9 in a straight line.

To protect the winding wire 4, the depression geometry in the transition region to the non-depressed surface 8 is provided with a radius 16. An embodiment is also conceivable in which a radius of this type is only provided at the axial mutually opposite side faces in the transition region to the surface 8, that is to say only in the region with which the winding wire 4 is in contact.

FIGS. 4*a* to 5*b* show an alternative exemplary embodiment of a contact element 5 with depression geometry, wherein to avoid repetitions, essentially differences from the previous exemplary embodiment are covered in the following. With regards to commonalities, reference is made to the previous exemplary embodiment. In contrast with the previous exemplary embodiment, the depression geometry 9 is not arranged with edge spacing, but rather extends laterally from the outside beyond the wide centre of the contact element 5. The depression geometry 9 is in the exemplary embodiment shown constructed as a lateral recess 17 preferably produced by stamping out, wherein the recess 17 does not necessarily have to be constructed as a blank as illustrated, rather it is conceivable that also a bottom produced by shaping and downwardly offset in the manner of a recess is realised.

Figure 5A:
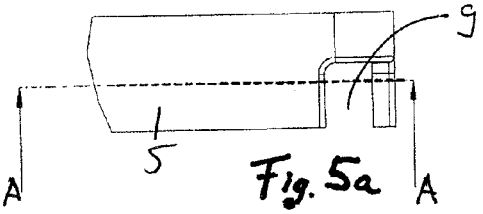
FIG. 5*a* shows the contact element according to FIG. 4*a* in the bent state.
Figure 4B:
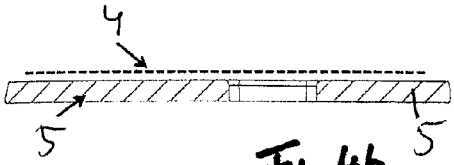
FIG. 4*b* shows a longitudinal sectional view of the illustration according to FIG. 4*a*.
Figure 5B:
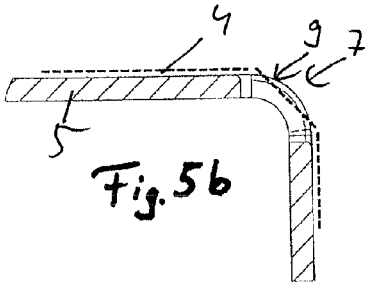
FIG. 5*b* shows a longitudinal sectional view of the illustration according to FIG. 5*a*.
Figure 6A:
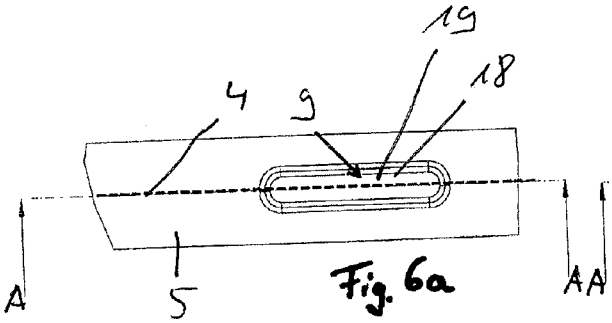
FIG. 6*a* shows an alternative exemplary embodiment of the depression geometry as depression tab.
Figure 7A:
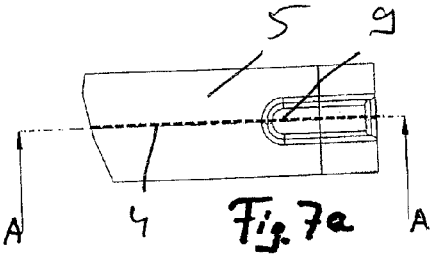
FIG. 7*a* shows the illustration of the contact element according to FIG. 6*a* in the bent state.
Figure 6B:
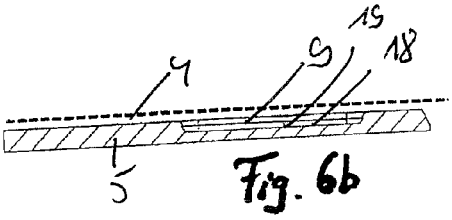
FIG. 6*b* shows a longitudinal sectional view of the illustration according to FIG. 6*a*.
Figure 7B:
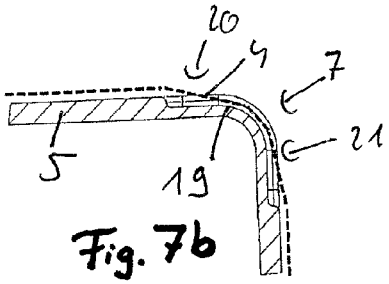
FIG. 7*b* shows a longitudinal sectional view of the illustration according to FIG. 7*a*.

As emerges from FIGS. 5*a* and 5*b*, the winding wire 4 runs in a straight line in the bending region 7 in the end mounting state.

In the following, a further exemplary embodiment of a contact element 5 with winding wire 4 and depression geometry 9 is described on the basis of FIGS. 6*a* to 7*b*. To avoid repetitions, essentially differences from the previous exemplary embodiments are covered in the following. With regards to commonalities, reference is made to the previous figures and the description of the figures.

In contrast with the previous exemplary embodiments, the depression geometry 9 is constructed in the exemplary embodiment according to FIGS. 6*a* to 7*b* as a depression recess 18 which, in contrast with an opening, has a bottom 19 and thus a bottom surface. The axial extent of the depression geometry 9 corresponds in the exemplary embodiment shown (in the unbent state) to 4.0 mm. It can be seen that the depression recess 18 is arranged with edge spacing from the longitudinal sides of the contact element 5, wherein an embodiment can also be realised analogously to the exemplary embodiment according to FIGS. 4*a* to 5*b*, in which the depression recess 18 extends at least as far as one longitudinal edge, alternatively also as far as both longitudinal edges. The depth of the depression recess 18 corresponds in the exemplary embodiment shown to approximately half of the thickness of the contact element 5, which means in the exemplary embodiment shown that the winding wire 4—in contrast with the previous exemplary embodiments—touches the contact element 5 in the bending region 7 here approximately centrally, as a result of which the winding wire 4 has a straight-line course in two axially adjacent, here axially spaced regions 20, 21, which course is connected by means of a bent section in which the winding wire 4 bears against the depression geometry on the bottom 19.

Figure 8:
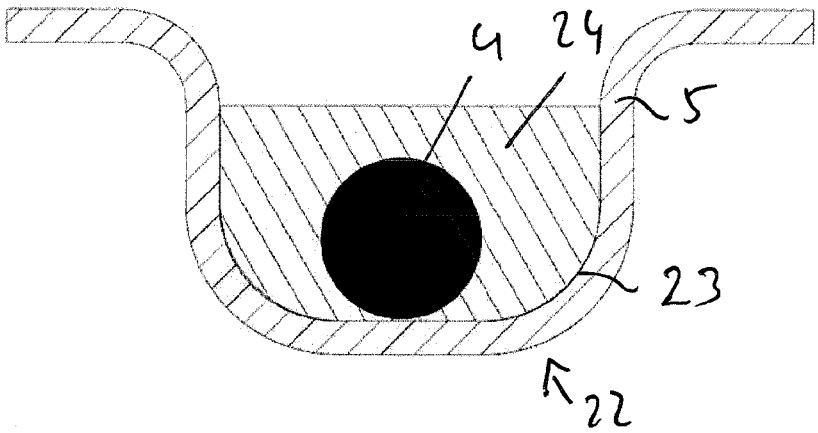
FIG. 8 shows a guide geometry for guiding the winding wire, wherein a basin-like geometry is chosen in which the winding wire is arranged with lateral spacing and the basin is filled with an adhesive.
Figure 9:
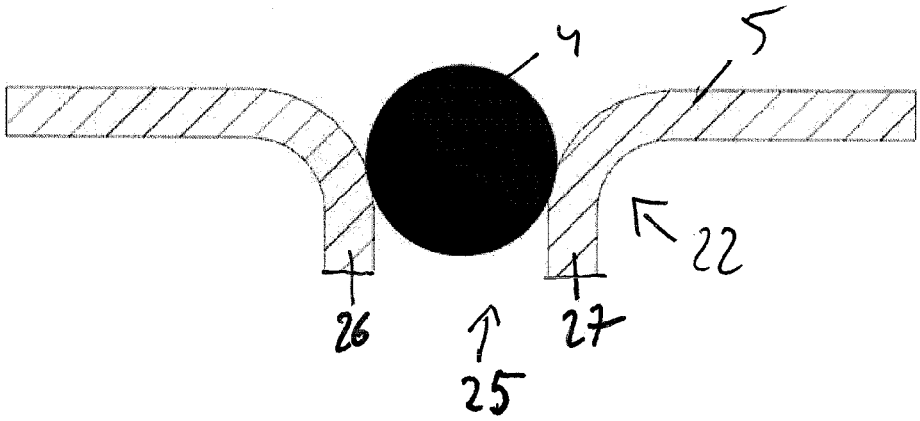
FIG. 9 shows an alternative illustration of a winding wire guide geometry constructed as fixing geometry, in which the winding wire is accommodated in a clamping manner between two sections of the contact element.
Figure 10:
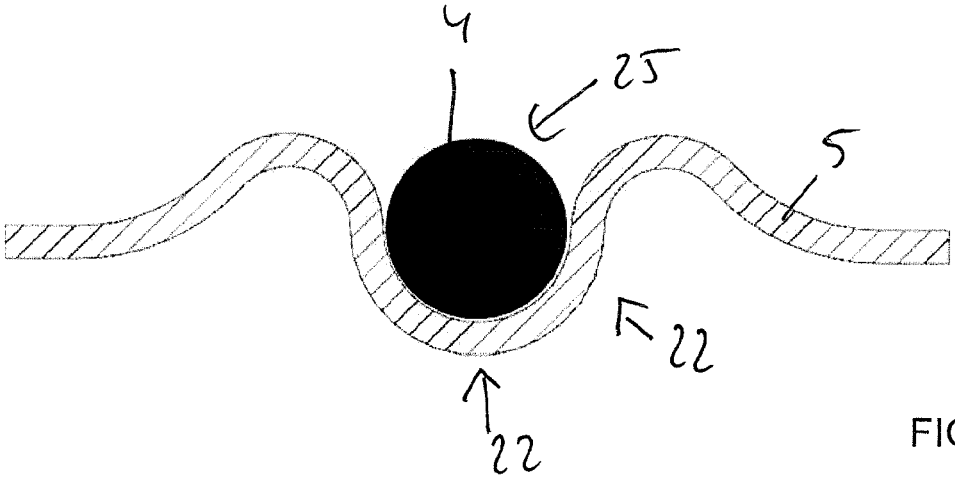
FIG. 10 shows an illustration of an alternative guide geometry constructed as fixing geometry, in which the winding wire is accommodated in a clamping manner in a type of wave geometry of the contact element.

Different exemplary embodiments of contact elements 5 are shown in FIGS. 8 to 10, which are all equipped with a winding wire guide geometry 22 in order to position the winding wire, here to centre it with respect to the centre of the width of the contact element 5. Preferably, the winding wire guide geometry is located in a region between the depression geometry not illustrated in FIGS. 8 to 10 and the free end of the contact element, preferably either upstream or downstream of a welding or soldering region, in which the winding wire is electrically conductively fixed on the contact element 5 by welding or soldering. In addition or alternatively, adhesive bonding, particularly with an electrically conductive adhesive bonding is conceivable.

The winding wire guide geometry 22 is constructed in the case of the contact element 5 according to FIG. 8, which is illustrated in a cross-sectional view, as a depression or an in some sections U-shaped recess, in which the winding wire 4 is arranged at a distance from the recess sides. The recess 23 is filled with adhesive 24 for the additional fixing of the winding wire 4.

In the exemplary embodiment according to FIG. 9, in which the contact element 5 is shown in a cross-sectional view extending perpendicularly to the longitudinal extent like in the exemplary embodiments according to FIG. 8 and FIG. 10, the winding wire guide geometry 22 is constructed as fixing geometry for the additional fixing of the winding wire 4. For this purpose, the contact element 5 is slotted in an axial section and the inwardly facing ends 26, 27 are offset downwards and accommodate the winding wire between them in a clamping manner. In a region upstream of the fixing geometry 25, the contact element 5 is constructed without the slot shown.

In the exemplary embodiment according to FIG. 10, the winding wire guide geometry 22 is likewise constructed as fixing geometry 25 in that the contact element 5 has been shaped to form a wave shape, wherein the winding wire 4 is accommodated in a clamping manner in a wave depression. It is ensured by means of the winding wire guide geometries 22 illustrated in FIGS. 8 to 10 that the winding wire 4 is located at the desired fixing position in the axially adjacent fixing region, particularly welding or soldering region and if appropriate adhesive-bonding region.

The invention claimed is:

1. An electromagnetic actuation device with an actuation element, which can be adjusted relative to a stator on the basis of a magnetic actuation force which can be generated by the stator, wherein the stator has a coil winding, the winding wire of which is guided to a contact element bent at a bending region and is fixedly and electrically conductively connected to the same, wherein the contact element (5) has a depression geometry (9) in a bending region (7), which shortens a bending path of the winding wire (4) and through which the winding wire (4) passes, wherein the depression geometry (9) has a longitudinal extent corresponding to an axial extent of the contact element, a width extent, and a thickness extent, and wherein the longitudinal extent is greater than the width extent, and wherein the width extent is greater than the thickness extent.

2. The actuation device according to claim 1, wherein the depression geometry (9) is constructed as a depression recess (18) or as an opening (13) or as a recess which is open at the side.

3. The actuation device according to claim 1, wherein the winding wire (4), at least in a region laid upstream of the depression geometry (9) and adjoining the depression geometry (9) and also in a region laid downstream of the depression geometry (9) and adjoining the depression geometry (9), runs on a surface (8) of the contact element (5) directed outwards.

4. The actuation device according to claim 1, wherein the depression geometry (9) is arranged centrally in relation to a width extent of the contact element (5) or extends at least as far as the middle of the contact element (5) from outside transversely to the longitudinal extent of the contact element (5).

5. The actuation device according to claim 1, wherein the bending path of the winding wire (4) is shorter than the longitudinal extent of an external shell contour of the contact element (5) in the bending region and/or is shorter than a neutral fibre of the contact element (5) in the bending region (7).

6. The actuation device according to claim 1, wherein the winding wire (4) is exclusively securely connected in an end section arranged downstream of the bending region (7) to a section of the contact element (5) projecting beyond a support body.

7. The actuation device according to claim 1, wherein the depression geometry (9) is produced by stamping, reshaping stamping or stamping out.

8. The actuation device according to claim 1, wherein the depression geometry (9) has a radius (16) in the transition region to the non-depressed contact element surface.

9. The actuation device according to claim 1, wherein the contact element (5) is constructed as a tab.

10. The actuation device according to claim 1, wherein both winding wire ends are electrically conductively fixed in each case to a contact element (5) having a depression geometry (9).

11. The actuation device according to claim 1, wherein a winding wire guide geometry (22) is provided on the contact element (5) for positioning the winding wire (4).

12. The actuation device according to claim 11, wherein the winding wire guide geometry (22) is constructed as a fixing geometry (25) for fixing the winding wire (4).

13. The actuation device according to claim 11, wherein the winding wire guide geometry (22) is arranged upstream or downstream of a fixing region in which the winding wire (4) is inductively welded or soldered on the contact element (5).

14. The actuation device according to claim 11, wherein the winding wire guide geometry (22) is constructed as a fixing geometry (25) fixing the winding wire (4) positively by clamping the winding wire (4) in the fixing geometry (25).

15. The actuation device according to claim 1, wherein the depression geometry (9) is substantially rectangular in shape.

* * * * *